US009592997B2

(12) United States Patent
Mertala

(10) Patent No.: US 9,592,997 B2
(45) Date of Patent: Mar. 14, 2017

(54) GUIDE RAIL INSTALLATION ARRANGEMENT AND A METHOD FOR INSTALLING GUIDE RAILS

(71) Applicant: KONE CORPORATION, Helsinki (FI)

(72) Inventor: Antti Mertala, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 14/818,950

(22) Filed: Aug. 5, 2015

(65) Prior Publication Data

US 2016/0060078 A1 Mar. 3, 2016

(30) Foreign Application Priority Data

Sep. 3, 2014 (EP) ..... 14183370

(51) Int. Cl.
*B66B 19/00* (2006.01)

(52) U.S. Cl.
CPC ..... *B66B 19/002* (2013.01)

(58) Field of Classification Search
CPC ..... B66B 19/002
See application file for complete search history.

(56) References Cited

U.S. PATENT DOCUMENTS 3,851,736 A 12/1974 Westlake et al.
8,186,130 B2 * 5/2012 Van Der Meijden ... B66B 19/00 187/249
8,720,032 B2 * 5/2014 Van der Meijden .... B66B 19/02 187/414
9,169,107 B2 * 10/2015 Wilts ..... B66B 19/002 52/741.1
2006/0243539 A1 * 11/2006 Cruz ..... B66B 19/002 187/408
2010/0133048 A1 * 6/2010 Barneman ..... B66B 19/00 187/414
2010/0287876 A1 * 11/2010 Van Der Meijden ... B66B 19/00 52/741.1
2012/0055002 A1 * 3/2012 van der Meijden .... B66B 19/02 29/428

(Continued)

FOREIGN PATENT DOCUMENTS

CA 2 894 485 A1 6/2014
DE 10 2012 104 993 A1 12/2013

(Continued)

*Primary Examiner* — Rodney Mintz
(74) *Attorney, Agent, or Firm* — Birch, Stewart, Kolasch & Birch, LLP

(57) ABSTRACT

A guide rail installation arrangement and a method for installing guide rails are disclosed. The guide rail installation arrangement for installing guide rails in an elevator shaft includes at least one vertically moveable working platform within the elevator shaft for reaching the installation height and a material hoist for moving guide rail sections for installing the guide rail sections. The guide rail installation arrangement further includes a transport frame for transporting guide rail sections vertically within the elevator shaft and a frame hoist that is attachable to the transport frame for vertically moving the transport frame and for optionally moving the guide rail sections for loading the guide rail sections into the transport frame.

19 Claims, 4 Drawing Sheets

(56) References Cited

U.S. PATENT DOCUMENTS

| | | | | |
|---|---|---|---|---|
| 2013/0118838 | A1* | 5/2013 | Plathin | D07B 1/02 187/251 |
| 2013/0284543 | A1* | 10/2013 | De Jong | B66B 11/00 187/249 |
| 2015/0107186 | A1 | 4/2015 | Wilts et al. | |
| 2015/0314993 | A1* | 11/2015 | Bolme | B66B 19/002 52/741.1 |
| 2015/0360913 | A1* | 12/2015 | Fernandez | B66B 7/1246 187/408 |
| 2016/0311659 | A1* | 10/2016 | Mertala | B66B 19/002 |

FOREIGN PATENT DOCUMENTS

| | | | |
|---|---|---|---|
| EP | 2 746 210 | A1 | 6/2014 |
| JP | 02300081 | A * | 12/1990 |
| JP | 2001-48440 | A | 2/2001 |
| JP | 2005-178947 | A | 7/2005 |
| WO | WO 2009/092844 | A1 | 7/2009 |

* cited by examiner

GUIDE RAIL INSTALLATION ARRANGEMENT AND A METHOD FOR INSTALLING GUIDE RAILS

TECHNICAL FIELD

The present disclosure relates to an arrangement and a method for installing guide rails in an elevator.

BACKGROUND ART

Guide rails are used to guide the vertical movement of an elevator car in an elevator shaft. Usually there are two guide rails on the opposite walls of the elevator shaft and the elevator car is located between them and linked to the guide rails through guide shoes or guide rollers facing the guide rails. Guide rails are constructed from multiple guide rail sections that are connected to each other from their vertical ends to form a continuous guiding structure for the elevator. The connection between two adjacent guide rail sections is secured through a connecting element, for example a fishplate, that is attached to both guide rail sections through bolts or similar. The guide rails are attached to the walls of the elevator shaft through brackets.

If the elevator is equipped with a counterweight, it typically runs along its own guide rails. The counterweight guide rails have a similar structure as the elevator car guide rails, but they are usually located closer to each other and they can be attached to the same wall.

Guide rails are typically installed in the elevator shaft in a bottom-up manner. The vertical line in which each guide rail should run is first established with the aid of a plumb line or a laser beam. The two bottom-most guide rail sections of a given guide rail pair are then attached to the walls through the brackets. The straightness of the guide rail sections is checked and adjusted through the brackets if necessary. Then, the next pair of guide rail sections is mounted on top of the first pair and attached to the wall as the previous guide rail sections. The straightness of the guide rail sections is checked in relation to the guide rail section below and adjusted through the brackets if necessary. The fishplate is then added at the formed junction and the ends are aligned. The process is repeated until all guide rails are complete.

Guide rail sections are usually several meters (feet) in length and made of steel. They are thus heavy and their handling during installation requires caution. During the installation of the guide rails, a temporary scaffold or a lift can be constructed in the elevator shaft for transporting material. The system usually incorporates a working platform, from which the installation work is performed. Usually, one guide rail section is attached to the working platform at the bottom floor of the elevator shaft or at an intermediate level where the guide rails are pre-transported. The guide rail section is then driven with the working platform to the installation height, installed and the next guide rail section is retrieved. Transporting the guide rail sections one by one is time-consuming and is a significant bottleneck during the elevator installation.

In the document WO 2009/092844 A1, a method for installing an elevator and guide rails of an elevator are disclosed. In the method, first the lowermost pair of guide rail sections is installed and at least one working platform is built between the guide rails. After this, the guide rail sections of the second pair of guide rail sections are fixed as an extension of the guide rails using the built working platform as an aid. Then, diverting pulleys are fixed to the top ends of the second guide rail sections and a hoist is fitted to the working platform for lifting the working platform upwards. Then, the rope suspension of the working platform is fitted so that the hoisting rope is arranged to pass at its first end from the hoist over the diverting pulleys at the top end of the guide rails and under the diverting pulleys that are in connection with the working platform to its fixing point of the second end of the working platform. After this, the working platform is lifted to the next working height by means of the hoist and is locked into position.

The drawbacks of the current solutions are that each guide rail is individually transported to the working height, which is very slow. Further, installation works have to be stopped for the time during which the next guide rail section is retrieved. The problems are exacerbated in high-rise buildings where the elevator hoisting distance is high and the time needed for the transportation of the guide rail section increases accordingly.

SUMMARY OF THE INVENTION

An object of the present invention is to provide an improved guide rail installation arrangement and a method for installing guide rails.

The guide rail installation arrangement and the method for installing guide rails are in particular, but not only, intended for elevators, especially for passenger or cargo elevators of buildings.

The guide rail installation arrangement according to the present disclosure is characterized by what is presented in claim 1.

The method according to the present disclosure is characterized by what is presented in claim 13.

BRIEF DESCRIPTION OF DRAWINGS

The accompanying drawings, which are included to provide a further understanding of the invention and constitute a part of this specification, illustrate embodiments of the invention and together with the description help to explain the principles of the invention but the invention is not limited to the specific embodiments illustrated in the drawings. In the drawings.

DETAILED DESCRIPTION

Figure 1:
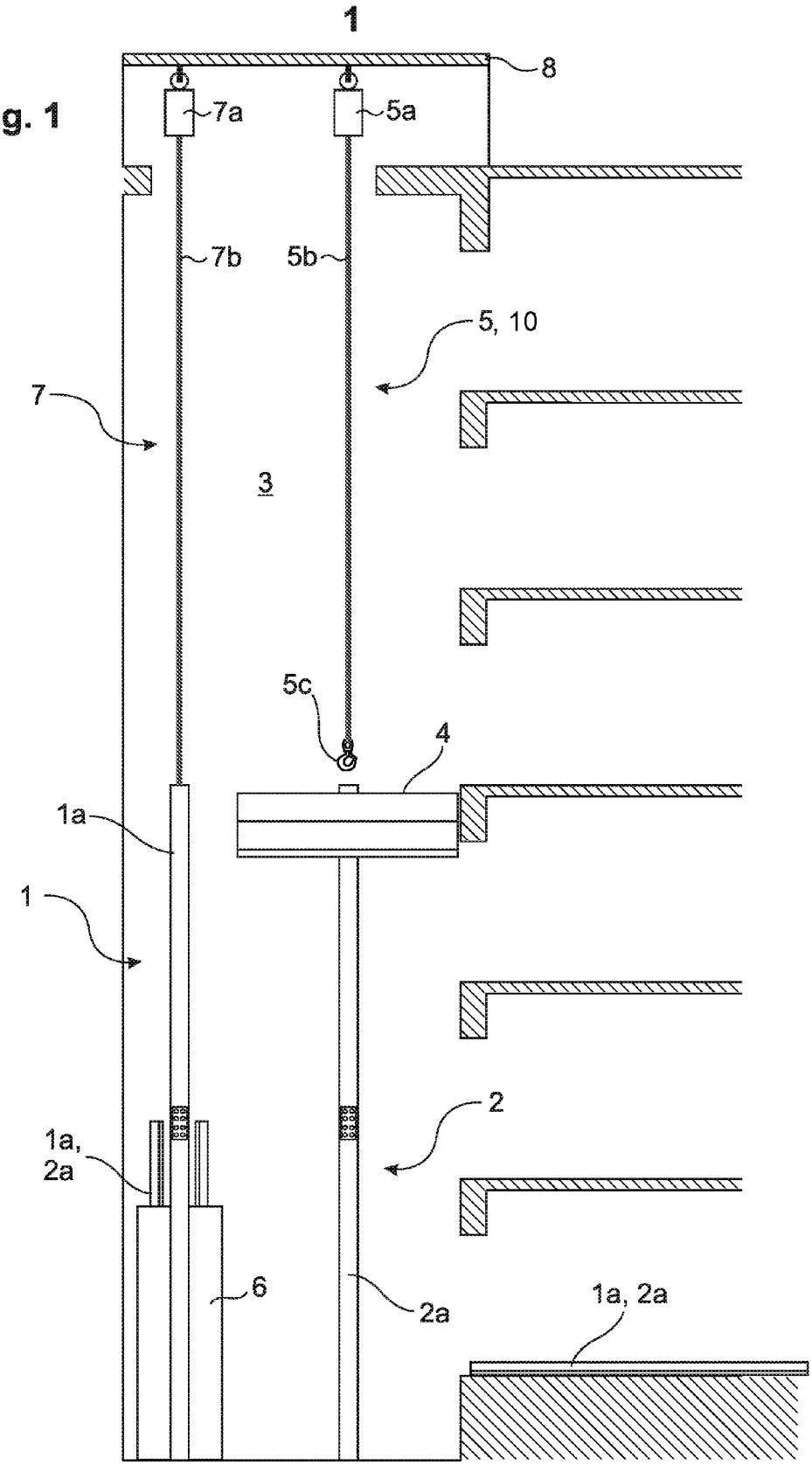
FIG. 1 presents a schematic overview of one embodiment of the guide rail installation arrangement according to the present disclosure.

In one aspect, a guide rail installation arrangement for installing guide rails in an elevator shaft is disclosed. The guide rail installation arrangement comprises at least one vertically moveable working platform within the elevator shaft for reaching the installation height and a material hoist for moving guide rail sections for installing the guide rail sections. The guide rail installation arrangement is characterized in that it further comprises a transport frame for transporting guide rail sections vertically within the elevator shaft and a frame hoist that is attachable to the transport frame for vertically moving the transport frame and for optionally moving the guide rail sections for loading the guide rail sections into the transport frame.

The guide rail installation arrangement is a temporary assembly which is meant to speed up guide rail installation procedure and to reduce idle time during the process. Any guide rail installation site can benefit from the arrangement according to the present disclosure. In elevators where the counterweight frame and/or the elevator car sling are impractical for being used in installing the guide rails, the guide rail installation arrangement according to the present disclosure might be advantageous. This is the case, for example, in elevators where the counterweight frame and/or the elevator car sling are especially heavy, such as in cargo elevators or in double-deck elevators. Also, if the installation height and/or the hoisting distance of the elevator are/is at least 50 meters (164 feet), the guide rail installation arrangement according to the present disclosure may be advantageous. By an installation height is herein meant the height above the bottom of the elevator shaft at which the guide rail sections are installed. The installation height increases with each added guide rail section that increases the height of the guide rail. The installation height is at its maximum when the last guide rail sections are installed at the top of guide rail.

An elevator system in which the guide rail installation arrangement according to the present disclosure can be used comprises at least two landings. By a landing is herein meant a location at which the elevator car can load or unload passengers or cargo. The hoisting distance of the elevator, i.e. the vertical distance between the lowest landing and the highest landing, is independent of the number of landings. The guide rail installation arrangement according to the present disclosure can be used for installing the guide rails in all elevator systems irrespective of the number of landings and the hoisting distance. It is possible for a building to have a shuttle elevator having landings in lobby floors. Such shuttle elevators are used, for example, in high-rise buildings where the distance between the landings can be up to hundreds of meters (feet).

The guide rail installation arrangement according to the present disclosure is constructed usually in the beginning of the guide rail installation procedure and disassembled when the guide rail installation is finished. In some situations, it can be used only during a part of the guide rail installation and other installation systems can be used complementarily. It is possible to use at least some components of the guide rail installation arrangement according to the present disclosure in other work phases of elevator installation as well. Therefore, it is possible to only partially construct the guide rail installation arrangement according to the present disclosure and also only partially to disassemble it. The components of the guide rail installation arrangement according to the present disclosure might be reusable in other installation sites. Guide rail installation arrangement according to the present disclosure can be used in all types of guide rail installations.

By a guide rail herein is meant a continuous rail that guides the substantially vertical movement of an elevator car or a counterweight in an elevator shaft. The guide rail for the counterweight is termed a counterweight guide rail. The guide rail for the elevator car is termed an elevator car guide rail. Typically guide rails are used as pairs, so that there is one guide rail on two opposite sides of the counterweight and the elevator car. However, especially the counterweight can only have one guide rail.

By a guide rail section is herein meant a section of a guide rail that is attachable or attached from its one end to an adjacent guide rail section or from its both ends to two adjacent guide rail sections. Guide rail sections are usually several meters (feet) in length, a length of 5 m (16.4 feet) being typical. They also vary in their width in different elevator constructions, but can have a width of, for example, 127 mm (5 inches). Guide rail sections are usually made of steel, although other materials might be suitable. The material and exact dimensions depend on the specific application for which the guide rail sections are used.

By installing the guide rail sections is herein meant the procedure according to the methods known in the art for constructing a functional guide rail. Typically, during the installation, the guide rail sections are fixed to the wall of the elevator shaft or other stable structures, attached to the adjacent guide rail section and the straightness of the guide rail is checked. The details of the procedure vary as is known to the skilled person.

By a working platform is herein meant a platform that is used for performing installation work in an elevator shaft during the building or maintenance work of the elevator. The working platform is typically suspended in its own hoisting system and can be driven along the guide rails installed in the elevator shaft. Any hoisting system known in the art can be used for the working platform according to the present disclosure. In one embodiment, the at least one working platform is vertically moveable by a working platform hoist.

A transport frame is a structure that is used primarily for transporting guide rail sections in a vertical direction in the elevator shaft. Typically, the guide rail sections are transported upwards in a transport frame. The guide rail sections can be brought to an intermediate height through a route outside of the elevator shaft. This is possible during the construction of a building by a crane, for example. Thus, it is not always necessary to transport all the guide rail sections from the bottom floor. This can be advantageous in high-rise buildings where the distance between the bottom floor and the highest installation heights can be hundreds of meters (feet).

The guide rail sections are loadable in the transport frame and transportable to the height at which they are installed. In most applications, the guide rail sections are loaded in a vertical position, i.e. in the same direction as they are going to be installed, in the transport frame. Usually the guide rail sections transported in or on a transport frame are substantially at the same horizontal level during the transport.

In some embodiments, the transport frame has a bottom portion supporting the guide rail sections from below. In some embodiments, however, it is possible that the guide rail sections hang from one or more suspenders mounted on the transport frame. The transport frame usually has a side portion for preventing the guide rail sections from swaying or otherwise moving during transport and/or for improving the balance of the transport frame. In one embodiment, the guide rail sections are transported within the transport frame. The transport frame typically further comprises some sort of connection means from which it is removably attachable to the frame hoist. It is possible that there are also dedicated fastening means for holding the guide rail sections to be transported in place. In one embodiment, the transport frame comprises fastening means for securing the guide rail sections in position for transport.

It might be possible to transport also other equipment with the aid of the transport frame according to the present disclosure. It is, however, primarily constructed and designed for transporting guide rail sections within the elevator shaft.

In one embodiment at least two, preferably at least four, more preferably at least six guide rail sections can be transported simultaneously by the transport frame. The guide rail installation arrangement according to the present disclosure allows the simultaneous transport of multiple guide rail sections to the installation height. The transport frame is configured to accommodate at least two guide rail sections. It is possible to use the transport frame for transporting only one guide rail section. More typically, however, at least two guide rail sections are transported at the same time in the transport frame. The number of guide rail sections to be transported can be adjusted according to the specific application. It is also possible to calculate beforehand, how many guide rail sections are needed and to load the transport frame accordingly. It is possible to load a variable number of guide rail sections in the transport frame.

It is possible to use the installed guide rails to guide the movement of the working platform and the transport frame. In one embodiment, the transport frame and/or the working platform are configured to run along guide rails. It is possible to use only the counterweight guide rails or elevator car guide rails or them both for this purpose. In one embodiment, the transport frame and the working platform are configured to run along different guide rails. In one embodiment, the transport frame is configured to run along counterweight guide rails and/or the working platform is configured to run along elevator car guide rails. In some situations, it might be possible to mount the working platform on the counterweight guide rails and the transport frame on the elevator car guide rails. However, in most cases, using the elevator car guide rails for the working platform allows it to be larger, providing a more convenient access to the components to be installed.

In order to move the transport frame along the guide rails, the transport frame can comprise guiding means, such as rollers, wheels or guide shoes, for guiding its movement along the guide rail. In one embodiment, the transport frame comprises guiding means, such as rollers, wheels or guide shoes, for guiding the movement of the transport frame along the guide rail. Typically, the transport frame moves between two guide rails, and the guiding means are situated on its both sides. There can be one or more guiding means on each side of the transport frame.

By a hoist or hoisting system is herein meant a system used for moving elevator components or machinery used in the installation of elevator components in a vertical or in a horizontal direction. A hoist or hoisting system comprises a device powering the movement of the objects to be moved, i.e. a traction hoist. Many such devices, for example wire rope climbers and winches, are known in the art. A commonly used one is a Tirak hoist. The hoist or hoisting system further comprises lifting means, such as a wire rope or a chain, and attachment means, such as a hook or a grapple for holding the object to be lifted. It can further comprise automation means for facilitating its operation and safety devices known in the art.

The material hoist is a hoisting system that is meant for moving a guide rail section to be installed from the transport frame to a position where it can be installed. Typically one guide rail section at a time is moved by the material hoist. The material hoist comprises attachment means that are designed for temporarily holding an individual guide rail section, such as a rail lifter. Alternatively, the material hoist can comprise a generic holding means to which a guide rail section-specific attachment means is connectable. Several alternatives are known in the art and selecting a suitable one is within the knowledge of the skilled person.

The frame hoist is a hoisting system meant for moving the transport frame vertically within the elevator shaft. It comprises an attachment means that can be removably attached to the transport frame. The number and weight of the guide rail sections to be transported affects the design of the frame hoist. This is due to the weight of the load, which can be substantial if many guide rail sections are to be transported simultaneously.

The material hoist and the frame hoist can be used for moving also other tools or components used in the elevator shaft, for example during the construction of the guide rail installation arrangement. For example, it is possible to use the material hoist or the frame hoist for moving guide rail sections from their storage location to the transport frame. If the frame hoist is used, this requires that the transport frame is either at the bottom of the elevator shaft or otherwise secured in place so that the support from the frame hoist is not necessary. The guide rail sections can be gripped with a suitable attachment means, such as a rail lifter, and guided with the aid of the material hoist or the frame hoist to the transport frame, secured in place and then released from the attachment means.

In one embodiment, the material hoist and/or the frame hoist are suspended from at least one lifting beam. By a lifting beam is herein meant a beam, running essentially across the elevator shaft and to which hoisting systems are secured. The lifting beam can be at any suitable height within the elevator shaft. Typically the lifting beam is affixed to strong structures at the top of the elevator shaft. There can be two or more lifting beams. Separate lifting beams can be used for the material hoist and for the frame hoist. It is possible to suspend also the working platform from a lifting beam. The lifting beam for the working platform can be the same or a different lifting beam that is used for the material hoist and/or the frame hoist. For example, it might be possible to have one lifting beam for the frame hoist and a separate lifting beam for the working platform hoist and the material hoist. In some applications, more than one lifting beam can be used for one hoisting system. Many alternative solutions for installing a lifting beam in the elevator shaft are known in the art and any of them can be used for the guide rail installation arrangement according to the present disclosure.

Other suspension structures can be used for the hoisting systems. For example, it might be possible to anchor the hoisting systems directly at the wall or ceiling of the elevator shaft. It might also be possible to use suspension means located outside the elevator shaft.

In one embodiment, the material hoist is moveable in an essentially horizontal direction for moving the guide rail sections. In order to move the guide rail sections from the transport frame to the position where they are installed, horizontal movement of the guide rail section might be necessary. For example, if the transport frame runs along the counterweight guide rail and a guide rail section for the elevator car guide rail is to be installed, it might facilitate the installation procedure to have a horizontally moveable material hoist. The material hoist can be, for example, suspended on a lifting beam through a moveable element that can move along the lifting beam. The movement of such a moveable element can be regulated manually or through an electrical system.

As the transport frame moves up and down in the elevator shaft, controls are used to run the hoisting system. In on embodiment, the movement of the transport frame is controlled manually. This means that there is a manual remote control unit that is operated from the working platform or from the level at which the guide rail sections are loaded on the transport frame.

In one embodiment, the transport frame is controlled semi-automatically or automatically. A semi-automatic controller comprises a control box with up and down buttons for driving the hoist and at the levels of the working platform and the guide rail section loading. In an automatic system, the transport frame is sent automatically down when it is empty and up when it is loaded. The automatic control can be governed by, for example, weight sensing.

Especially if the transport frame is controlled semi-automatically or automatically, the guide rail installation arrangement according to the present disclosure can comprise one or more limit switch. It is, however, possible also for a manually operated guide rail installation arrangement to comprise limit switch(es). In one embodiment, the guide rail along which the transport frame moves, has a stationary limit switch at the bottom end of the guide rail and/or a moveable limit switch at the top end of the guide rail. The stationary limit switch at the bottom end of the guide rail prevents the transport frame from running too low in the elevator shaft. It can be installed as a permanent device or it can be removable after the installation work. Correspondingly, the moveable limit switch at the top end of the guide rail prevents the transport frame from running too high along the guide rail. It is typically moveable together with the working platform and thus follows the lengthening of the guide rail as the installation work progresses. This allows the transportation of the guide rail sections always to a suitable height for installing the next guide rail section.

When the transport frame is being loaded, installation work higher up in the elevator shaft has to be stopped for safety reasons. If the level at which the loading takes place, for example the bottom floor of the elevator shaft, is sufficiently protected, the installation work can continue uninterrupted. In one embodiment, the guide rail installation arrangement further comprises protection means at the bottom of the elevator shaft for protecting persons and machinery therein from falling items. The protection means can be, for example, a protection deck. It is an impact-resistant sandwich structure able to withstand blows effected by falling guide rail sections or other heavy objects. The protection means can be installed at any height above the space that is necessary for operations at the bottom of the elevator shaft.

In another aspect, a method for installing guide rails in an elevator shaft is disclosed. In the method, at least one of the bottom-most guide rail sections is installed and the guide rail installation arrangement according to the present disclosure is constructed simultaneously or sequentially in any order (step a)). Then, a predetermined number of guide rail sections is loaded onto the transport frame (step b)). Then the transport frame and the working platform are moved simultaneously or sequentially in any order to a first height for installing the next guide rail sections (step c)). After this, one guide rail section is moved by the material hoist from the transport frame and the guide rail section is installed (step d)). Step d) is repeated for all the guide rail sections to be installed on that height (step e)). Then, the working platform is moved to a next height for installing the next guide rail sections. Simultaneously or sequentially in any order, either the transport frame is moved to the next height for installing the next guide rail sections, or the transport frame is moved to a predetermined position for loading a predetermined number of guide rail sections onto the transport frame, the guide rail sections are loaded onto the transport frame, and then the transport frame is moved to the next height for installing the next guide rail sections.

In step a) of the method, at least one of the bottom-most guide rail sections is installed. This means that the installation of either counterweight guide rails and elevator car guide rails or one of them is started. It might be possible to start the installation by installing only one guide rail section. However, usually a pair of guide rail sections is installed simultaneously or closely one after the other. In other words, if the guide rails function as a pair, both lowermost guide rail sections for the counterweight and/or elevator car are installed. At the same time or before or after this, the rest of the guide rail installation arrangement components are constructed. In other respects the installation of the guide rails follows methods known in the art, including plumbing, attachment, etc.

In case the transport frame and the working platform run along guide rails, the transport frame and the working platform have to be set in place after the guide rails are in place. The construction of other components of the guide rail installation arrangement is, however, independent from the installation of the guide rails.

After the guide rail installation arrangement is ready, step b) of loading a predetermined number of guide rail sections onto the transport frame can be performed. The number and type of the guide rail sections to be loaded depends on the specifics of the application. For example the hoisting distance of the elevator, the length and weight of the guide rail sections and the carrying capacity of the transport frame and the structures supporting it have an effect on how many guide rail sections will be loaded in step b). The guide rail sections are usually brought to the installation site already beforehand in accordance with established practices.

The loading of the guide rail sections is performed using essentially known methods. In some situations, it might be possible to use either the material hoist or the frame hoist for moving the guide rail sections from their storage location and/or loading them onto the transport frame. In one embodiment, the frame hoist is used in step b) and/or in step f) when loading a predetermined number of guide rail sections. The guide rail sections are in this case grabbed by the attachment means, such as a hook or a grapple possibly including a suitable adaptor for holding a guide rail and lifted on or near the transport frame. It is also possible to use the material hoist for this purpose. In one embodiment, the material hoist is used in step b) and/or in step f) when loading a predetermined number of guide rail sections.

At step c), the transport frame carrying the guide rail sections and the working platform are lifted to a first height for installing the next guide rail sections. The transport frame and the working platform can be driven to the first height at the same time or one after the other. Their movement can also overlap partly so that one of them starts earlier than the other.

The working platform is controlled as is typical for such working platforms. Usually, the working platform is controlled manually by a person in the working platform. The transport frame can also be driven manually from the working platform or from another location at the construction site. In case the transport frame is controlled semi-automatically or automatically, limit switches are installed, possibly already at step a).

The first height, as well as the next heights, for installing the next guide rail sections does not need to be exactly the same for the working platform and for the transport frame.

They are driven to a height which is suitable for performing the installation work and one of them can be lower than the other. Typically, the transport frame and the working platform are substantially at the same height. The first height for the transport frame can be lower than the first height of the working platform in order to facilitate the removal of the guide rail sections from the transport frame. Additionally, the term first height, as well as the term next height, are not to be understood as specific heights. Instead, the term means a suitable height for doing installation work that differs from the height in which the same working phase was done for the previous guide rail section. Thus, in practice, the working platform and the transport frame can be moved up and down during the installation of a given guide rail section and still remain at the first or next height, respectively.

At step d), one guide rail section is moved by the material hoist from the transport frame and the guide rail section is installed. The material hoist is first attached to the guide rail section to be installed. In case the material hoist is horizontally moveable, it is first moved to be substantially above the transport frame and then attached to the guide rail section to be installed. The material hoist can be equipped with an attachment means designed for holding guide rail sections. Alternatively, the guide rail sections can have an adapter for attaching them to a generic attachment means, such as a hook, of the material hoist. Then, the guide rail section is released and removed from the transport frame. The guide rail section is moved substantially horizontally to be in the vicinity of the guide rail to which it will be attached. In case the material hoist is horizontally moveable, the horizontal movement is effected from the hoist. If the material hoist is stationary in a horizontal direction, the horizontal movement of the guide rail section from the transport frame to the installation position is effected with other means, either manually or machine-assisted. Typically, the position of the guide rail section is adjusted also in the vertical direction with the aid of the material hoist. Once the guide rail is in the installation position, the installation is done according to known procedures.

Step e) of the method comprises repeating step d) for the rest of the guide rail sections to be installed on that height. In one embodiment, both counterweight and elevator car guide rail sections are installed at each height. In such a case, step e) comprises repeating step d) for three times for installing altogether four guide rail sections at the first height as well as at the following heights. In case the counterweight only has one guide rail, the number of steps is reduced by one.

The guide rails for the counterweight can be made of identical guide rail sections as the elevator car guide rails or they can be different. If the guide rail sections for the counterweight guide rails and for the elevator car guide rails are different, this has to be taken into account when loading the guide rail sections onto the transport frame.

In some embodiments of the method, it is possible that steps d) and e) partly overlap. In this case, the previous guide rail section is already secured in place, but the installation work is still ongoing while the next guide rail section is already being moved. The exact timing of each step depends on the installation specifics and the optimization of the procedure can be done on-site.

At step f), the working platform is moved to a next height for installing the next guide rail sections. At this point, the possible limit switches can be installed or moved upwards from a lower location. If there are guide rail sections in the transport frame, it can also be moved to the next height for immediately continuing the installation work. This can take place before or after moving the working platform, as well as simultaneously or partially at the same time with the moving of the working platform. Alternatively, if the transport frame is empty, the transport frame is moved to a predetermined position for loading a predetermined number of guide rail sections onto the transport frame. This can also be done if there are so few guide rail sections in the transport frame that their installation is not considered efficient. The predetermined position to which the transport frame is moved can be the bottom floor, the lowermost landing, or an intermediate landing. The guide rail sections are loaded onto the transport frame and then the transport frame is moved to the next height for continuing the installation work. In one embodiment, the guide rail sections are loaded onto the transport frame in steps b) and/or f) at the bottom floor of the elevator shaft or at an intermediate floor of the elevator shaft. In case the limit switches were not installed immediately after moving the working platform to the next height, this can still be done at any point before the transport frame reaches the next height.

In one embodiment, the counterweight guide rails are installed essentially simultaneously with the elevator car guide rails. This means that the transport frame is always brought as close as possible to the installation height to minimize the distance that the guide rail sections need to be transported individually. In case the transport frame runs along the counterweight guide rail(s), they need to be constructed approximately at the same time as the elevator car guide rails.

In some situations, however, it might be practical to, for example, load more elevator car guide rail sections into the transport frame and construct the elevator car guide rails further than the counterweight guide rails. At the next round of filling the transport frame, more counterweight guide rail sections can be retrieved and the counterweight guide rail can be constructed further.

In one embodiment, at step f), the transport frame is kept at the first height while the working platform is moved to the next height at least once and the guide rail sections are installed at the next height. In these situations, the transport frame containing guide rail sections remains at the first height while the working platform is moved upwards to the next height. The working platform might have to move between the first height and the next height when the next guide rail sections to be installed are removed from the transport frame.

If the guide rails are so long that they are not finished after step f), steps d) to f) can be repeated for finishing the guide rails. In one embodiment, steps d)-f) are repeated at least once. However, the method for installing guide rails according to the present disclosure can be combined with other methods known in the art and it is not necessary to use solely this method. It might, for example, be possible to begin the installation with prior-art methods and start using the current method only after the guide rails have been constructed to a predetermined length.

The guide rail installation arrangement and the method for installing guide rails according to the present disclosure might offer at least one of the following advantages over prior art:

The guide rail installation is faster, since more than one guide rail can be installed in sequence without having to retrieve a new guide rail section after installing the previous one. In the guide rail installation arrangement and in the method according to the present disclosure, the distance a guide rail needs to be moved individually is minimized.

As the working platform and the transport frame are separate from each other, the installation work can continue while the transport frame is moving, further improving the efficiency of guide rail installation. This advantage can be effected while the transport frame moves either down- or upwards. If the bottom of the elevator shaft is appropriately protected, the installation work can continue also during the time new guide rail sections are loaded on the transport frame.

The guide rail installation arrangement and the guide rail installation method according to the present disclosure can reduce the costs of elevator installation, since the working time required is shortened and the time used by installation personnel can be used more effectively.

DESCRIPTION OF DRAWINGS

Figure 2:
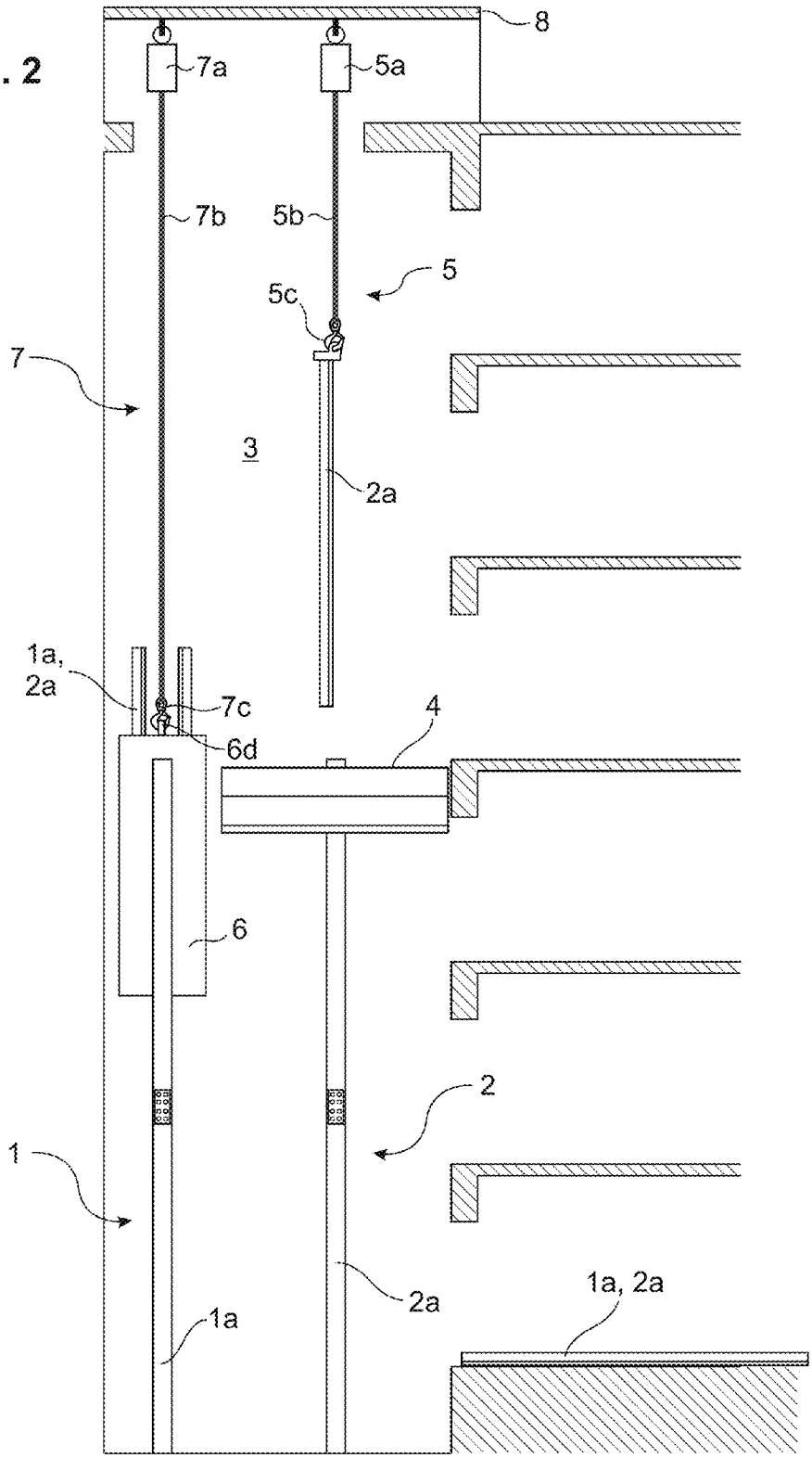
FIG. 2 presents the guide rail installation arrangement of FIG. 1 when a guide rail section is moved from a transport frame.

FIGS. 1 and 2 present an elevator shaft 3 comprising six landings in which the guide rail installation arrangement according to the present disclosure is situated. There are various controlling and safety devices for the guide rail installation arrangement, but all of them have been omitted from the figures for clarity and any conventional methods can be used for their design. All parts of the guide rail installation arrangement are depicted only schematically and their sizes are not drawn proportionally. Further, all additional elevator components are omitted from the figures, although some of them might be installed before or simultaneously with the guide rails.

In the embodiment of FIGS. 1 and 2, the guide rail installation arrangement comprises a vertically moveable working platform 4 that is configured to run along the elevator car guide rails 2. Although in this embodiment there are two elevator car guide rails 2, only the one on the foreground in the viewing direction of FIGS. 1 and 2 is visible. The working platform is supported by a hoisting system. For example, the working platform 4 is vertically moveable by a working platform hoist 10. The working platform 4 can be constructed by means known in the art. In FIGS. 1 and 2, the working platform 4 is at the height at which the next guide rail section 1*a*, 2*a* is to be installed. In other words, the working platform 4 is close to the upper end of the thus far installed guide rails 2. Guide rail sections 1*a*, 2*a* for both guide rails 1, 2 can be installed from this position.

In addition to guide rail 1, 2 installation, it might be possible to perform additional installation work relating to, for example, other elevator components, such as doors or lighting, from the working platform 4. This could be done to avoid idle time during the installation when guide rail sections 1*a*, 2*a* are retrieved from below, for example.

The guide rail installation arrangement further comprises a transport frame 6. In this embodiment, the transport frame 6 runs along the counterweight guide rails 1, of which there are two, although only one is visible in the viewing direction of FIGS. 1 and 2. The transport frame 6 is partially behind the guide rail 1 as it is located between the two guide rails 1. The transport frame 6 according to this embodiment is a basket-like structure where the guide rail sections 1*a*, 2*a* stand upright in two rows. The transport frame has a bottom portion 6*a* on which the guide rail sections 1*a*, 2*a* rest and a side portion 6*b* that holds the guide rail sections 1*a*, 2*a* upright. There might be additional fastening or support structures in the transport frame 6 to allow the safe and stable transport of the guide rail sections 1*a*, 2*a*. The transport frame 6 has rollers, wheels or guide shoes 9 at its sides to mediate the contact with the guide rails 1. In FIGS. 1 and 2 they are behind the counterweight guide rail 1. The transport frame 6 also has connection means 6*d*, for example a loop or a lifting eye, from which it is removably attachable to the frame hoist 7. The connection means 6*d* is visible in FIG. 2.

Each of the guide rails 1, 2 along which the transport frame 6 and the working platform 4 run, comprise two guide rail sections 1*a*, 2*a* in FIGS. 1 and 2. All support structures for the guide rails 1, 2, which are as known in the art, are omitted. Further, the guide rails 1, 2 are depicted to start from the bottom of the elevator shaft 3, which is not necessarily the case. In this embodiment, the elevator car guide rails 2 and the counterweight guide rails 1 are constructed from identical guide rail sections 1*a*, 2*a*, but different types of guide rail sections 1*a*, 2*a* could also be used.

The embodiment of FIGS. 1 and 2 further comprises a material hoist 5. It comprises a traction hoist 5*a*, that can be any rope climber or a winch known in the art, for example a Tirak hoist, capable of lifting heavy enough loads for the present purpose. The material hoist 5 additionally comprises lifting means 5*b*, which is typically a wire rope or cable. In a typical application, the lifting means 5*b* is reelable into a device contained, for example in the traction hoist 5*a* or in its vicinity to avoid the presence of loose wire 5*b* in the elevator shaft 3. The length of the lifting means 5*b* can be optimized so, that it can reach the bottom of the elevator shaft 3, or another suitable height, if it is used for lifting the guide rail sections 1*a*, 2*a* from the storage location to the transport frame 6. The material hoist 5 also comprises an attachment means 5*c*, which in this case is a hook. For lifting guide rail sections 1*a*, 2*a*, special rail lifters are commonly used as attachment means 5*c* or, as in this embodiment, attached to the attachment means 5*c*. The material hoist 5 can further comprise running, automation and safety devices, which are all omitted from the figures.

In FIGS. 1 and 2, the material hoist 5 is suspended from a lifting beam 8 at the top of the elevator shaft 3. In some embodiments, the lifting beam 8 can be located lower in the elevator shaft. Lifting beams 8 are known in the art and selecting a suitable for each construction site is within the knowledge of the skilled person. It is possible to mount the material hoist 5 horizontally moveably on the lifting beam 8.

The material hoist 5 can alternatively be attached directly to the structures of the elevator shaft 3. In FIGS. 1 and 2, the material hoist 5 hangs in line with the elevator car guide rails 2. As the material hoist 5 is meant for moving the guide rail sections 1*a*, 2*a* between the transport frame 6 and their installation positions, it might also be positioned in the middle of the elevator shaft 3 cross section. Due to, for example, location of the lifting beam 8, other positions of the material hoist 5 are also possible. Further, sheaves, attached either to the lifting beam 8 or to the elevator shaft 3 structures, can be used for directing the pulling direction of the material hoist 5.

The material hoist 5 is mainly used for moving guide rail sections 1*a*, 2*a*, from the transport frame 6 for installing them. In most cases this movement is substantially horizontal when the transport frame 6 is approximately at the height at which the guide rail sections 1*a*, 2*a* are being installed. FIG. 1 depicts the material hoist 5 in one possible idle position whereas in FIG. 2, a guide rail section 2*a* is being moved from the transport frame 6 by the material hoist 5. It depends on the design of the transport frame 6 if the guide rail sections 1*a*, 2*a* need to be first lifted upwards to remove them from the transport frame. In FIG. 2, the guide rail section 2*a* is above the position to which it will be installed.

Thus, in this embodiment, also slight downward movement of the guide rail section 2*a* is effected by the material hoist 5.

In some embodiments, the material hoist 5 can be used for loading of the guide rail sections 1*a*, 2*a* on the transport frame 6 as well.

The embodiment of FIGS. 1 and 2 further comprises a frame hoist 7. It is structurally analogous to the material hoist and thus comprises a traction hoist 7*a*, lifting means 7*b*, attachment means 7*c* and possibly additional devices for running the frame hoist 7. Also automation and safety devices can be present.

The frame hoist 7 is suspended from the same lifting beam 8 as the material hoist 5. The frame hoist 7 can also have its own lifting beam 8. A suitable position for the frame hoist 7 is in the middle of the counterweight guide rails 1 for easy balancing of the transport frame 6. However, the pulling direction of the frame hoist 7 can be adjusted by sheaves, for example, so other positions are also possible.

The frame hoist 7 is mainly used for moving the transport frame up and down in the elevator shaft 3. The frame hoist 7 is removably attached to the transport frame 6 in order to allow its use for other work as well. Therefore, the transport frame 6 can comprise locking mechanisms for securing it in place in case the frame hoist 7 is detached when the transport frame 6 contains load and/or is above the bottom of the elevator shaft 3.

In the embodiment of FIGS. 1 and 2, the guide rail sections 1*a*, 2*a* are stored at the bottom floor. In elevators with many, for example more than ten, landings, it is possible to have one or more additional storage location in the intermediate landings. The guide rail sections 1*a*, 2*a* are retrieved from the storage location by the frame hoist 7 or the material hoist 5 and loaded on the transport frame 6. It is possible to use sheaves or pulleys attached to the guide rails 1, 2, guide rail installation arrangement components or to the elevator shaft 3 structures to direct the pulling direction of the material hoist 5 or the frame hoist 7 when loading the guide rail sections 1*a*, 2*a* onto the transport frame 6.

In this embodiment, the guide rail sections 1*a*, 2*a* stand in the transport frame 6 in two rows, one row on each side of the connection means 6*d*. The number of the guide rail sections 1*a*, 2*a* can vary, although in most applications, a substantially balanced load is used. Thus, often a paired number of guide rail sections 1*a*, 2*a* is loaded on the transport frame 6. When the transport frame 6 contains the desired number of guide rail sections 1*a*, 2*a*, the transport frame 6 is attached to the frame hoist 7 through the attachment means 7*c* if it is not already attached. It is then driven either manually, semi-automatically or automatically to the desired height, which is usually approximately at the top end of the ready guide rail or guide rails 1, 2.

Also the working platform 4 is driven to the suitable height, if it is not there already. The personnel doing the installation work can ride on the working platform 4 and adjust the relative positions of the transport frame 6 and the working platform 4 therefrom. It is also possible to run the transport frame 6 and/or the working platform 4 from another location, such as from the bottom floor of the elevator shaft 3.

Next, the attachment means 5*c* of the material hoist 5 is attached to the guide rail section 1*a*, 2*a* to be installed. The guide rail section 1*a*, 2*a* in question is released from the transport frame 6 and removed, or simply lifted out in case no releasable fastening means are present.

The guide rail section 1*a*, 2*a* is then moved to a suitable position to be installed. If the material hoist 5 is fixed to one position at the top part of the elevator shaft 3, the controlled movement of the guide rail section 1*a*, 2*a* has to be ensured to avoid uncontrolled swinging of the guide rail section 1*a*, 2*a*. To this end, for example pulleys or sheaves attacked to suitable positions within the elevator shaft or on the guide rail installation arrangement can be used. It is also possible to have the material hoist 5 moveably attached to the top part of the elevator shaft 3. For example wheels or rollers running along a lifting beam 8 can be used. This kind of a system would allow the lifting of the guide rail section 1*a*, 2*a* directly upwards from the transport frame 6 and directly downwards at its installation position. The horizontal movement of the material hoist 5 can be brought about by electrical controls.

The installation of the guide rail section 1*a*, 2*a* takes place through procedures known in the art. As soon as the material hoist 5 can be released from the guide rail section 1*a*, 2*a* being installed, it can be moved to remove the next guide rail section 1*a*, 2*a* from the transport frame 6. When all the guide rail sections 1*a*, 2*a* of a certain height are installed, the transport frame 6 and the working platform 4 are driven to the new top end of the guide rails 1, 2, respectively and the process is repeated if necessary.

When all the guide rail sections 1*a*, 2*a* are taken from the transport frame 6, it can be manually, semi-automatically or automatically driven to the storage location of the guide rail sections 1*a*, 2*a*, for re-filling. After the transport frame 6 is loaded, it is driven up again.

When the installation is completed, the transport frame 6 is driven to a position where it can be removed from the elevator shaft 3, typically at the bottom of the elevator shaft. The working platform 4 can be used for continuing installation work in the elevator shaft 3, but if it is not needed, it can also be driven down, dismantled and removed.

Figure 3A:
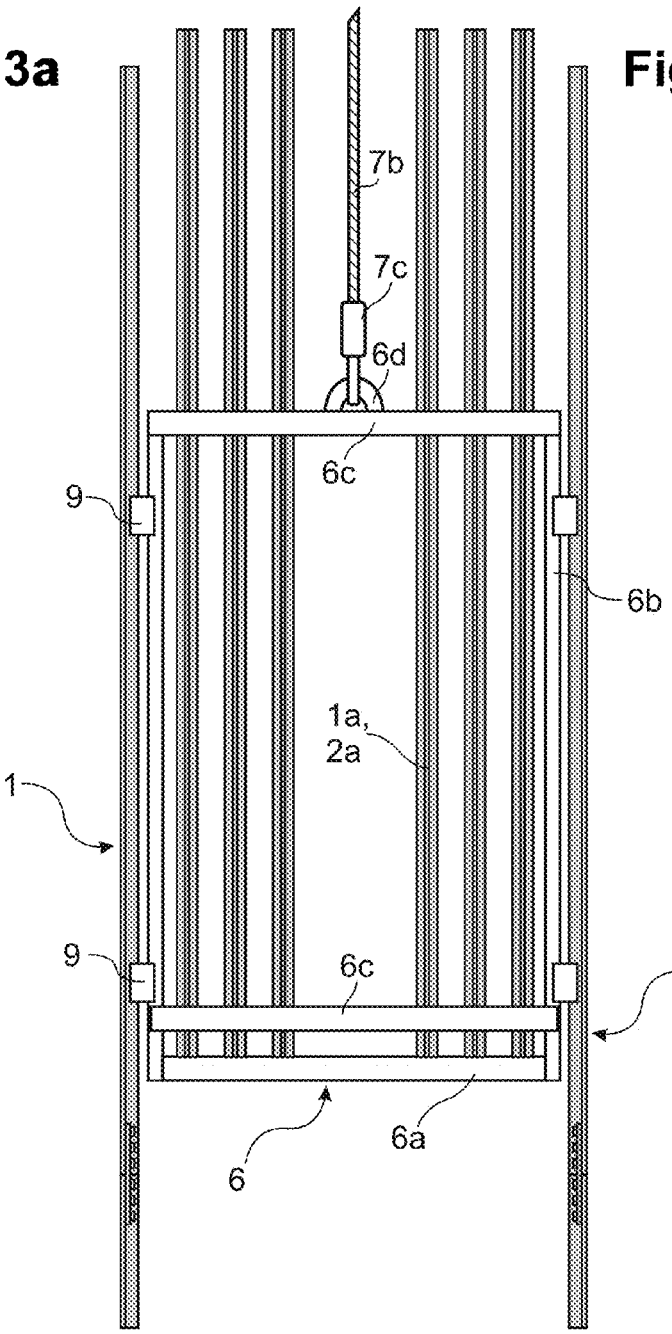
FIG. 3*a* presents a schematic overview of an embodiment of a transport frame according to the present disclosure viewed from the middle of the elevator shaft.
Figure 3B:
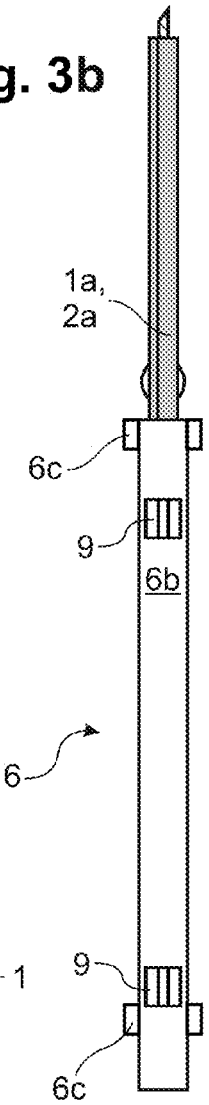
FIG. 3*b* presents the embodiment of FIG. 3*a* from the direction of a guide rail.

FIGS. 3*a* and 3*b* present a schematic overview of an embodiment of a transport frame 6 according to the present disclosure. In this embodiment, the transport frame 6 is a light-structured rack made of, for example, steel or aluminum. The transport frame can be assembled by, for example, welding. Alternatively attachment components, such as screws or bolts can be used for assembling the transport frame 6.

The transport frame 6 comprises a bottom portion 6*a*, two side portions 6*b* and four horizontal support portions 6*c*, the last being arranged in two pairs, one higher and one lower. In this embodiment, the upper support portions 6*c* are at the level of the tops of the side portions 6*b*, but they could alternatively be lower. Also the position of the lower support portions 6*b* could be different. There could be more than two pairs of support portions 6*c* or there could be only one pair. The purpose of the support portions 6*c* is to prevent the guide rail sections 1*a*, 2*a* from moving in the transport frame 6. The load of the guide rail sections 1*a*, 2*a* rests on the bottom portion 6*a* and the side portions 6*b* serve mainly as a structural framework for the transport frame 6.

In FIGS. 3*a* and 3*b*, a single row of guide rail sections 1*a*, 2*a* is loaded on the transport frame 6. The transport frame 6 surrounds them in a cage-like manner. The guide rail sections 1*a*, 2*a* are approximately evenly spaced on each side of the midpoint of the transport frame 6 in lateral direction. The transport frame 6 is thus substantially balanced.

The transport frame 6 is located between the counterweight guide rails 1. The frame hoist 7 (of which only the lifting means 7*b* and attachment means 7*c* are visible in FIGS. 3*a* and 3*b*) lifts the transport frame 6 directly upwards from the connection means 6*d*. Guide shoes 9 attached to the side portions 6*b* of the transport frame 6 mediate the contact between the transport frame 6 and the guide rails 1. There are two guide shoes 9 on each side of the transport frame 6. Instead of guide shoes 9, other guiding means 9, such as guide rollers or wheels 9 could be used.

If the guide shoes extend to both sides of the guide rail blade (i.e. the inward-pointing "leg" of a T-profiled guide rail), they lend support against the transport frame 6 from tipping over due to the height and heaviness of the guide rail sections 1*a*, 2*a* in it.

In FIG. 3*a*, there are six guide rail sections 1*a*, 2*a* visible in the transport frame 6. The maximum number of guide rail sections 1*a*, 2*a* that can be transported simultaneously depends among other things, on the design specifics of the guide rail sections 1*a*, 2*a* and the transport frame 6. Thus, there is no definite upper limit for the number of guide rail sections 1*a*, 2*a* that can be transported simultaneously.

Figure 4:
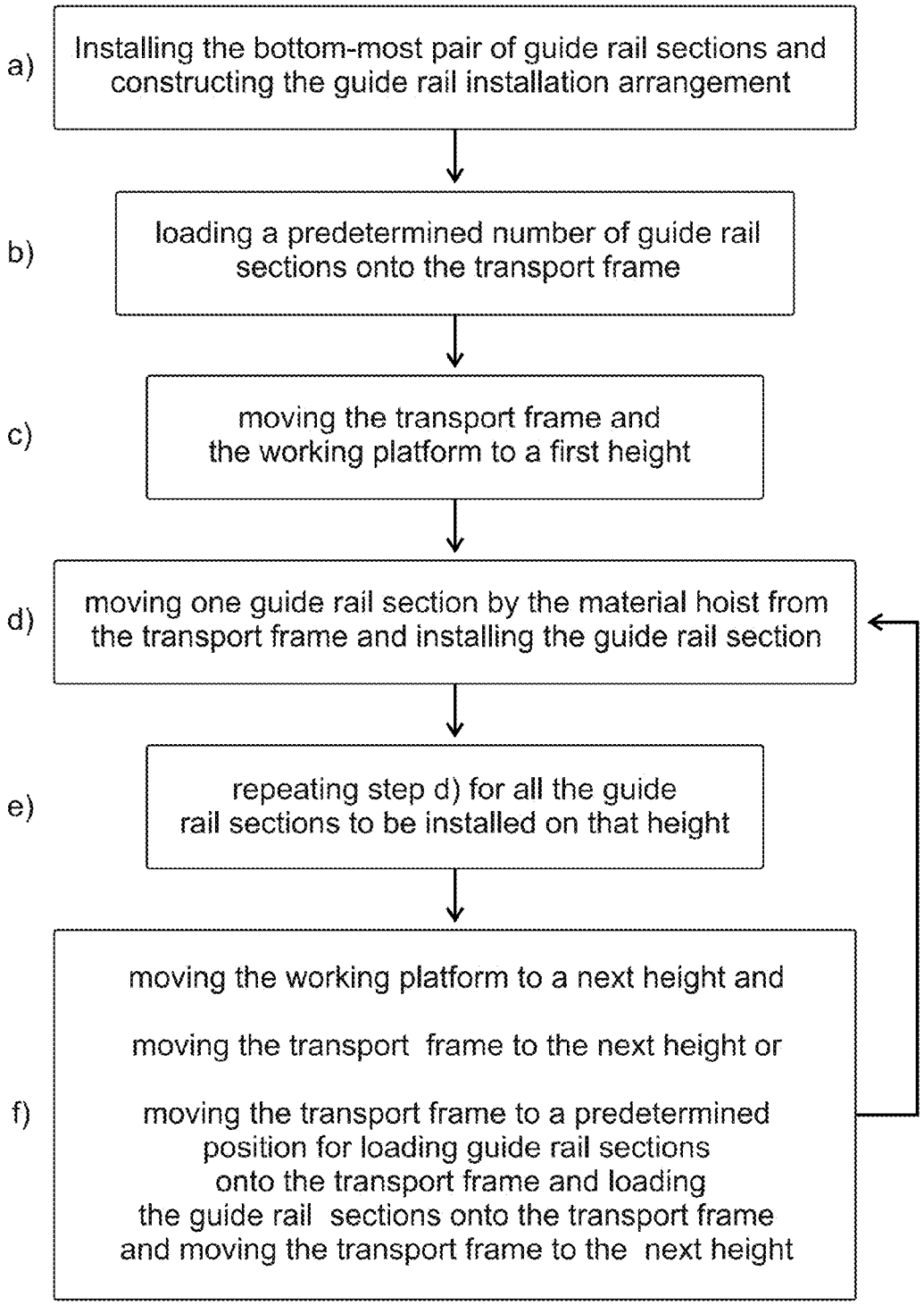
FIG. 4 is a flow-chart illustration of the method according to the present disclosure.

FIG. 4 is a flow-chart illustration of the method according to the present disclosure.

At step a), at least one of the bottom-most guide rail sections 1*a*, 2*a* is installed and the guide rail installation arrangement according to the present disclosure is constructed. The two working phases can be performed in parallel or one after the other in any order. Then, at step b) a predetermined number of guide rail sections 1*a*, 2*a* are loaded onto the transport frame 6. At step c) the transport frame 6 and the working platform 4 are moved to a first height for installing the next guide rail sections 1*a*, 2*a*. Also these working phases are independent of each other so, that they can be done simultaneously or sequentially in any order.

Step d) comprises moving one guide rail section 1*a*, 2*a* by the material hoist 5 from the transport frame 6 and installing the guide rail section 1*a*, 2*a*. At step e), step d) is repeated for all the guide rail sections 1*a*, 2*a* to be installed on that height. The number of repetitions can vary between 0 and 3, but is typically 1 or 3.

Step f) comprises moving the working platform 4 to a next height for installing the next guide rail sections 1*a*, 2*a* and of either moving the transport frame 6 to the next height for installing the next pair of guide rail sections 1*a*, 2*a* or moving the transport frame 6 to a predetermined position for loading a predetermined number of guide rail sections 1*a*, 2*a* onto the transport frame 6, loading the guide rail sections 1*a*, 2*a* onto the transport frame 6, and then moving the transport frame 6 to the next height for installing the next pair of guide rail sections 1*a*, 2*a*. The working platform 4 moves independently of the working phases concerning the transport frame 6. Therefore, these two working phases can be performed simultaneously or sequentially in any order. As explained above, the transport frame 6 can either move directly to the next height or it can retrieve more guide rail sections 1*a*, 2*a* and then move to the next height.

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A guide rail installation arrangement for installing guide rails in an elevator shaft, the guide rail installation arrangement comprising:

at least one vertically moveable working platform within the elevator shaft for reaching an installation height, wherein the at least one working platform is vertically moveable by a working platform hoist;

a material hoist for moving guide rail sections and for installing the guide rail sections;

a transport frame for transporting the guide rail sections vertically within the elevator shaft; and a frame hoist that is attachable to the transport frame for vertically moving the transport frame and for optionally moving the guide rail sections and for loading the guide rail sections into the transport frame, wherein the material hoist is provided independent of the frame hoist.

2. The guide rail installation arrangement according to claim 1, wherein at least two guide rail sections are transported simultaneously by the transport frame.

3. The guide rail installation arrangement according to claim 1, wherein at least one of the transport frame and the working platform are configured to run along guide rails.

4. The guide rail installation arrangement according to claim 1, wherein the transport frame and the working platform are configured to run along different guide rails.

5. The guide rail installation arrangement according to claim 1, wherein at least one of the transport frame is configured to run along counterweight guide rails and the working platform is configured to run along elevator car guide rails.

6. The guide rail installation arrangement according to claim 1, wherein at least one of the material hoist and the frame hoist are suspended from at least one lifting beam.

7. The guide rail installation arrangement according to claim 1, wherein the material hoist is moveable in a horizontal direction for moving the guide rail sections.

8. The guide rail installation arrangement according to claim 1, wherein the guide rail sections are transported within the transport frame.

9. The guide rail installation arrangement according to claim 1, wherein the transport frame comprises a guide for guiding the movement of the transport frame along the guide rail.

10. The guide rail installation arrangement according to claim 1, wherein the transport frame is controlled semi-automatically or automatically.

11. The guide rail installation arrangement according to claim 1, wherein the guide rail along which the transport frame moves, has at least one of a stationary limit switch at a bottom end of the guide rail and a moveable limit switch at a top end of the guide rail.

12. The guide rail installation arrangement according to claim 1, wherein at least six guide rail sections are transported simultaneously by the transport frame.

13. A method for installing guide rails in an elevator shaft comprising the steps of:

a) installing at least one of the bottom-most guide rail sections and constructing the guide rail installation arrangement according to claim 1 simultaneously or sequentially in any order;

b) loading a predetermined number of guide rail sections onto the transport frame;

c) moving the transport frame and the working platform simultaneously or sequentially in any order to a first height for installing the next guide rail sections;

d) moving one guide rail section by the material hoist from the transport frame and installing the guide rail section;

e) repeating step d) for all the guide rail sections to be installed on that height; and f) moving the working platform to a next height for installing the next guide rail sections and, simultaneously or sequentially in any order, either:

moving the transport frame to the next height for installing the next pair of guide rail sections; or moving the transport frame to a predetermined position for loading a predetermined number of guide rail sections onto the transport frame, loading the guide rail sections onto the transport frame, and then moving the transport frame to the next height for installing the next pair of guide rail sections.

14. The method according to claim 13, wherein at step f), the transport frame is kept at the first height while the working platform is moved to the next height at least once and the guide rail sections are installed at the next height.

15. The method according to claim 13, wherein steps d)-f) are repeated at least once.

16. The method according to claim 13, wherein both counterweight and elevator car guide rail sections are installed at each height.

17. The method according to claim 13, wherein the frame hoist is used in at least one of step b) and step f) when loading a predetermined number of guide rail sections.

18. The method according to claim 13, wherein counterweight guide rails are installed at the same time that elevator car guide rails are installed.

19. The method according to claim 13, wherein the guide rail sections are loaded onto the transport frame in at least one of steps b) and f) at a bottom floor of the elevator shaft or at an intermediate floor of the elevator shaft.

* * * * *